US011357296B2

(12) United States Patent
Vitau

(10) Patent No.: US 11,357,296 B2
(45) Date of Patent: Jun. 14, 2022

(54) PIECE OF JEWELLERY, METHOD FOR CUTTING A STONE, IN PARTICULAR A DIAMOND, AND ASSOCIATED MOUNTING PIN

(71) Applicant: HAMARD VITAU, Paris (FR)

(72) Inventor: Philippe Vitau, Paris (FR)

(73) Assignee: HAMARD VITAU, Paris (FR)

( * ) Notice: Subject to any disclaimer, the term of this patent is extended or adjusted under 35 U.S.C. 154(b) by 8 days.

(21) Appl. No.: 16/982,206

(22) PCT Filed: Mar. 21, 2019

(86) PCT No.: PCT/EP2019/057039
§ 371 (c)(1),
(2) Date: Sep. 18, 2020

(87) PCT Pub. No.: WO2019/180116
PCT Pub. Date: Sep. 26, 2019

(65) Prior Publication Data

US 2021/0022460 A1 Jan. 28, 2021

(30) Foreign Application Priority Data

Mar. 21, 2018 (FR) ..... 1852419

(51) Int. Cl.
*A44C 17/02* (2006.01)
*A44C 17/04* (2006.01)
*A44C 17/00* (2006.01)

(52) U.S. Cl.
CPC ..... *A44C 17/04* (2013.01); *A44C 17/001* (2013.01)

(58) Field of Classification Search
CPC ..... A44C 17/04; A44C 17/001; A44C 17/05; A44C 17/02; A44C 17/0208; A44C 17/0216; A44C 17/0225; A44C 17/005
See application file for complete search history.

(56) References Cited

U.S. PATENT DOCUMENTS 1,052,141 A * 2/1913 Gaschke ..... A44C 17/0208 63/29.1
2,069,598 A * 2/1937 Arpels ..... A44C 17/02 63/29.1
2,141,363 A * 12/1938 Rigollet ..... A44C 17/04 63/29.1

(Continued)

FOREIGN PATENT DOCUMENTS

CN 2896975 Y 5/2007
CN 104486964 A 4/2015

(Continued)

OTHER PUBLICATIONS

International Search Report and Written Opinion for PCT/EP2019/057039 dated May 9, 2019.

(Continued)

*Primary Examiner* — Jack W Lavinder
(74) *Attorney, Agent, or Firm* — Greer, Burns & Crain, Ltd

(57) ABSTRACT

A round stone is intended for being inserted contiguously with other similar stones to as to conceal the setting of the stones. Facets are bevel-formed between the girdle and the pavilion. Grooves, open at the two ends thereof, are formed, as by sawing in a plane perpendicular to the axis, in the facets to receive the setting claws.

29 Claims, 4 Drawing Sheets

(56) References Cited

U.S. PATENT DOCUMENTS

| | | | | | |
|---|---|---|---|---|---|
| 4,738,240 | A | | 4/1988 | Aich | |
| 4,813,246 | A | | 3/1989 | Richards | |
| 5,072,601 | A | * | 12/1991 | Slowinski | A44C 17/005 63/28 |
| 5,123,265 | A | * | 6/1992 | Ramot | A44C 17/04 63/28 |
| 5,423,196 | A | * | 6/1995 | Pollack | A44C 17/005 63/28 |
| 5,520,017 | A | * | 5/1996 | Vivat | A44C 17/005 63/28 |
| 5,649,434 | A | * | 7/1997 | Itzkowitz | A44C 17/005 63/26 |
| 5,713,219 | A | * | 2/1998 | Itzkowitz | A44C 17/005 63/26 |
| 5,848,539 | A | * | 12/1998 | Ouzounian | A44C 17/04 63/28 |
| 6,003,335 | A | * | 12/1999 | Gurevich | A44C 17/005 63/26 |
| 6,112,552 | A | | 9/2000 | Hoffman | |
| 6,453,700 | B1 | * | 9/2002 | Avril | A44C 17/005 63/26 |
| 6,668,584 | B1 | * | 12/2003 | Tosti | A44C 17/02 63/26 |
| 8,096,146 | B1 | * | 1/2012 | Adlakha | A44C 17/04 63/28 |
| 9,402,450 | B2 | * | 8/2016 | Huynh | B23P 5/00 |
| 2018/0042344 | A1 | | 2/2018 | Douglas et al. | |

FOREIGN PATENT DOCUMENTS

| | | | |
|---|---|---|---|
| CN | 206453367 | U | 9/2017 |
| EP | 1068815 | A2 | 1/2001 |
| FR | 2609605 | | 7/1988 |
| FR | 2836341 | A1 | 8/2003 |
| FR | 2839247 | A1 | 11/2003 |
| GB | 191074 | A | 8/1938 |
| WO | 0170067 | A1 | 9/2001 |

OTHER PUBLICATIONS

Search Report received in French Application No. 1852419 dated Oct. 18, 2018.

First Office Action and Search Report received for Chinese Application No. 201980033979.3, dated Mar. 25, 2022 (English Translation).

* cited by examiner

PIECE OF JEWELLERY, METHOD FOR CUTTING A STONE, IN PARTICULAR A DIAMOND, AND ASSOCIATED MOUNTING PIN

BACKGROUND

The present invention relates to a piece of jewellery having stones, in particular diamonds, which are round, and in particular circular.

The present invention also relates to a method for cutting a stone, in particular a diamond, with a view to incorporating it in the piece of jewellery.

The present invention also relates to a mounting pin for supporting a stone of the piece of jewellery.

The pieces of jewellery aimed at by the invention can be rings, bracelets, watches, necklaces or elements of necklaces, earrings, hair accessories, buttons, etc., or else objects other than those intended for the adornment of the body, in other words any object decorated with precious or semi-precious stones, in particular diamonds.

The round, in particular circular, shape is to be understood in the broad sense, this shape being able to be produced in an approximate way by a number of flat polygons. Said round shape is understood in contrast with a "square" or "rectangular" shape, or any other geometry with sides the presence of which is dominant for the visual effect of the whole.

Several documents (EP 0196 455 B1, EP 0201 394 A1, EP 0276 183 A1, FR 2 580 541 A1, FR 2 609 605 A1) describe pieces of jewellery where square stones are mounted contiguously, like paving, concealing the mount located below the periphery of the stones, called "girdle". This is most often produced by means of notches formed in the edges of the bottom part of the stones, called "pavilion", which has a pyramidal general shape for square stones. The mount has conformations engaging with these notches. Once mounted, the stones are wedged against each other, side of a square against side of a square.

U.S. Pat. Nos. 5,649,434 A and 5,713,219 A disclose stones which are retained onto their supporting structure by means of two opposed lips.

The purpose of the invention is to make it possible to conceal the mount for a piece of jewellery having round stones, typically a mat of round stones.

SUMMARY

According to a first aspect of the invention, the piece of jewellery with:

- at least one stone, in particular a diamond, having a visible face with a round general shape and a pavilion with a conical general shape having an axis, separated from the visible face by a peripheral girdle, and
- a mount located essentially on the side of the pavilion and having claws for supporting the stone, is characterized in that:

- the girdle has a certain height measured parallel to the axis;
- the stone has at least three facets overlapping the girdle and the pavilion, locally forming a bevel between the pavilion and the girdle; and
- each facet has a groove dug into it, extending transverse to the axis and receiving a lip of one of said claws.

The pavilion has an angle at the top which is relatively open and dictated by the desire for optimum refraction of light. The facet with the steeper gradient makes the engagement of a machining tool easier. Moreover, a groove which is less deep is sufficient to give the claw of the mount grip, making it possible to hold the stone securely. The at least three claws provided make it possible to position the stone positively independently of the neighbouring stones.

The girdle typically has a cylindrical general shape. A girdle with a cylindrical shape is favourable for the bevel-cutting of the facet.

According to an advantageous embodiment, in each facet the associated groove is open at both of its ends across a respective lateral edge of the facet. This configuration of the facet makes it possible to clean the groove perfectly after the machining thereof. This is important for the purity of the light effects in the piece of jewellery. In particular, the groove can have a substantially constant profile over its full length, from one open end to the other.

In an embodiment, the bottom of the groove extends in a rectilinear longitudinal direction, in particular parallel to the plane of the facet. This embodiment is simple and effective for making a good grip of the claw in the groove possible.

In an advantageous embodiment, the groove is formed in a plane perpendicular to the axis. For example, it can be a sawing carried out in said plane.

The bottom of the groove is typically a surface parallel to the axis. This is obtained for example by sawing in a plane perpendicular to the axis as mentioned above.

In a preferred embodiment, the stone has four facets and four grooves.

According to an embodiment, the angle between the axis and a median of a facet located in an axial plane is of the order of 40°. This represents approximately 10° less than the half-angle at the top of the pavilion of a conventional round diamond.

Preferably, the facets leave the girdle intact over the circumference of the upper face. In this way, the existence of the facets has no impact on the appearance of the stone after it has been mounted in the piece of jewellery.

In an embodiment, the facets locally reduce the height of the girdle to a non-zero value. This is favourable for a stable point of contact between adjacent stones.

According to an embodiment, the facets are grouped in pairs of neighbouring facets arranged in a V with respect to each other, the pairs being spaced apart from each other, preferably distributed evenly around the axis.

In particular for stones with a small size, the mount has, for each pair of facets, two abovementioned claws having a common foot, separated from the foot of the at least one other pair of claws. However, it is also possible, in particular for larger stones, for the mount to have, for each facet, a claw connected to the base independently of the other claws.

In an embodiment, the mount comprises a plate and, for each abovementioned stone, a pin bearing the claws associated with this stone. The pin preferably has means for snapping into a respective recess in the plate.

Preferably, the claws associated with one and the same stone are elastically flexible in the direction in which they move apart from each other to receive the stone by snapping the stone in between the associated claws. This makes the operations for assembling the piece of jewellery easier.

Typically, in the piece of jewellery the stones are mounted with contact or near contact between the girdles of the neighbouring stones. This is how the mount on the assembled piece of jewellery is best concealed. As the stones are round, they are not in contact with each other over their full circumference, but only at certain points of contact or near contact. Preferably, it is ensured that the claws are located underneath these points of contact or near contact between girdles, rather than underneath areas where the neighbouring stones leave a space between them.

According to a second aspect of the invention, the method for cutting a stone, in particular a diamond, with a view to producing a piece of jewellery according to the preceding aspect or any one of its developments or combination of developments, the stone having a visible face with a round general shape and a pavilion with a conical general shape having an axis, separated from the visible face by a peripheral girdle, is characterized in that at least three facets overlapping the girdle and the pavilion are cut into the stone, locally forming a bevel between the pavilion and the girdle; and each facet has a groove dug into it, extending transverse to the axis.

The operation of cutting the facets preferably remains below an upper limit of the girdle, so as not to affect the appearance of the stone as seen on the finished piece of jewellery.

In an embodiment of the method, before the facets are cut, the periphery of the stone is cut again so as to reduce its dimension perpendicular to the axis over its full circumference and jointly make an axial height of the girdle appear or increase. This makes it easier to produce the facets and makes it possible to give them a steeper gradient, which will make it easier to machine the groove.

Typically, the grooves are formed by sawing, in particular in a plane perpendicular to the axis.

In an embodiment, the sawing is deep enough that the groove has a retaining face undercut along its edge remote from the girdle.

According to a third aspect of the invention, the mounting pin for a piece of jewellery according to the first aspect or any one of its developments or combinations of developments, is characterized in that it comprises:

a common base equipped with means for snapping into a plate; and at least three claws distributed around an axis, each having a snap-in lip directed towards the axis, and capable of moving apart from each other by elastic bending.

In an embodiment, the pin has an even number of claws, grouped in pairs of neighbouring claws, the pairs being distributed evenly around the axis.

In particular for mounting stones with small dimensions, the two claws of one and the same pair are connected to the base by a common foot, separate from the foot of the at least one other pair.

Other features and advantages of the invention will in turn become clear from the description below, relating to non-limitative examples.

DETAILED DESCRIPTION

The present description extends to the embodiments described, but also to any feature or combination of features, in the terms used or in more general terms, even if these features or combinations of features originate from one part of a sentence, one part of a paragraph, or from several parts of a sentence or paragraph, when the feature or combination of features is different from the state of the art and produces an advantage over the state of the art.

Figure 1:
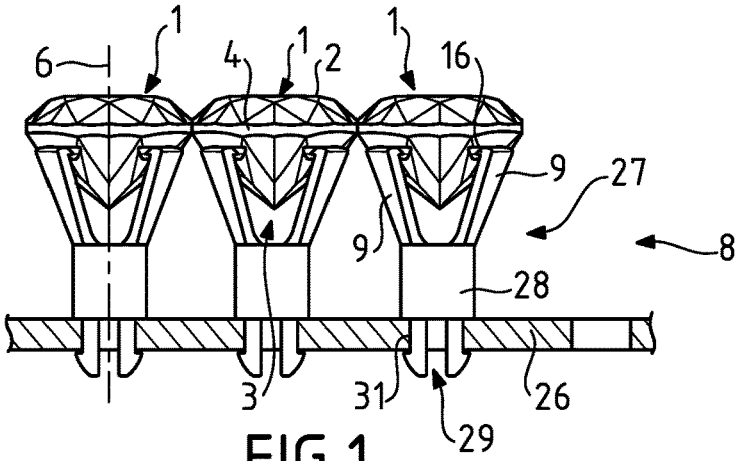
FIG. 1 is a partial elevation view of a piece of jewellery according to the invention, with a cross section of the plate.
Figure 2:
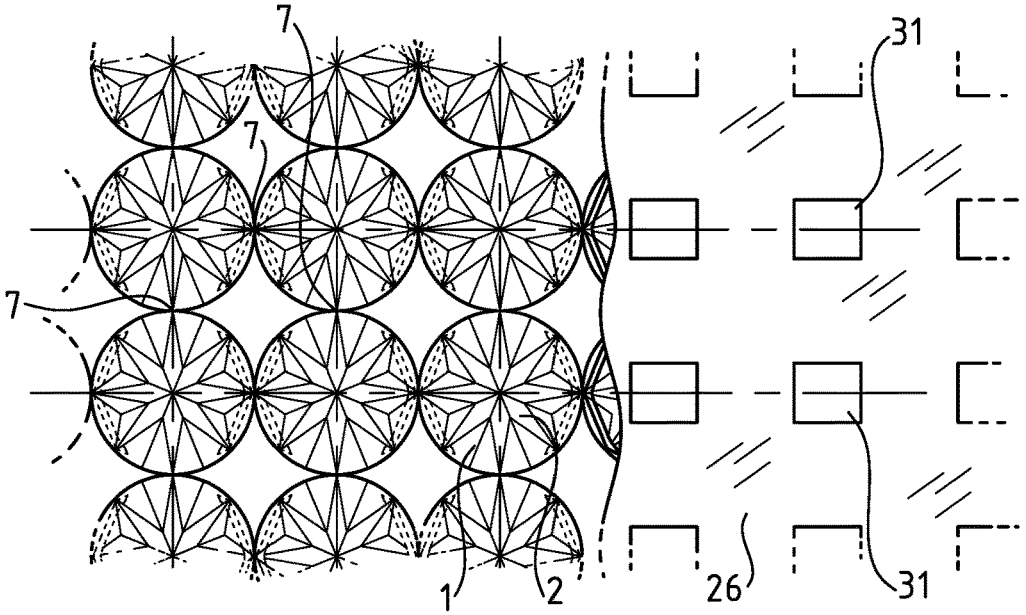
FIG. 2 is a partial view from above of the piece of jewellery of FIG. 1, the right-hand part of the figure showing only the plate.

In the example of FIGS. 1 and 2, the piece of jewellery comprises several stones 1, in particular diamonds, which have a round, in particular circular, shape when viewed from above (FIG. 2). Each stone 1 has a visible face 2 and a pavilion 3 separated from the visible face by a girdle 4 which forms the periphery of the stone and defines its diameter, which is typically several mm, for example 4.7 mm here. The girdle here has a cylindrical shape. The pavilion 3 has a conical general shape along an axis 6 which constitutes the axis of the stone and in particular the axis of the girdle 4 and the axis of the visible face 2. The conical general shape here is defined by a number of flat polygons (triangles), in a conventional manner for jewellery. In the embodiment represented, the stones 1 are adjacent to each other and in particular are in contact or near contact with each other through their girdles 4, at points of contact or near contact 7.

The piece of jewellery moreover comprises a mount 8 located essentially on the side of the pavilion 3 of the stones and having claws 9 for supporting the stones. In an embodiment the claws 9 belong to pins 27 each assigned to a respective one of the stones, and which each bear four claws 9. The mount 8 also comprises an underlying plate 26, in which the pins 27 are fixed, in a way that will be described in detail below.

With reference to FIGS. 3 to 6, the stone preferred for implementing the invention will now be described in more detail. The girdle 4 has a certain height measured parallel to the axis, the average value of which is denoted h (FIG. 4), the precise height fluctuating along the circumference because of curves created by the intersection of the cylinder of the girdle with the planes of the polygons defining the conical shape and other flat faces present on the circumference of the visible face 2 of the stone.

The stone moreover has, for each claw, a facet 13 which overlaps the girdle 4 and the pavilion 3, locally forming a bevel between the pavilion 3 and the girdle 4. Each facet 13 encroaches on the girdle 4 and locally reduces the axial height of the girdle 4 compared with the value h. However, said axial height is not cancelled out; the facets 13 leave the girdle intact over the circumference of the upper face 2. The presence of the facets 13 is not directly perceptible when the visible face 2 is observed along the axis 6.

Each facet 13 has a groove 14 dug into it, extending transverse to the axis 6 and receiving a lip 16 (FIG. 1) of a respective one of said claws 9. Here, each groove 14 has a longitudinal direction 17 (see FIG. 6 for one of the grooves) perpendicular to the axis 6.

In each facet 13 the associated groove 14 is open at both of its ends 18 across a respective lateral edge 19 of the facet.

In an embodiment, the bottom of the groove 14 extends in a rectilinear longitudinal direction, preferably parallel to the plane of the corresponding facet 13.

Typically, each groove 14 is formed in a plane 21 (FIG. 5) perpendicular to the axis 6. In the example represented, this plane is the same for all the grooves 14 of the stone.

In the embodiment represented, the bottom 22 (FIG. 5) of the groove is a surface parallel to the axis 6. When the longitudinal direction of the groove is rectilinear, then this surface of the bottom is flat.

The represented embodiment of the stone has four facets 13 and four grooves 14.

In an embodiment, the angle A (FIG. 5) between the axis 6 and a median 23 (FIGS. 3 and 5) of a facet located in an axial plane is of the order of 40°, i.e. approximately 10° less than the half-angle at the top B of the cone formed by the pavilion 3.

Figure 3:
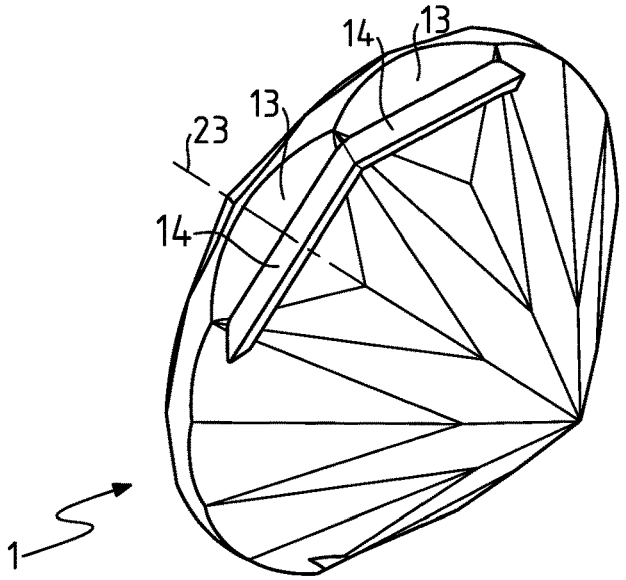
FIG. 3 is a perspective view of a stone of the piece of jewellery of FIGS. 1 and 2.
Figure 4:
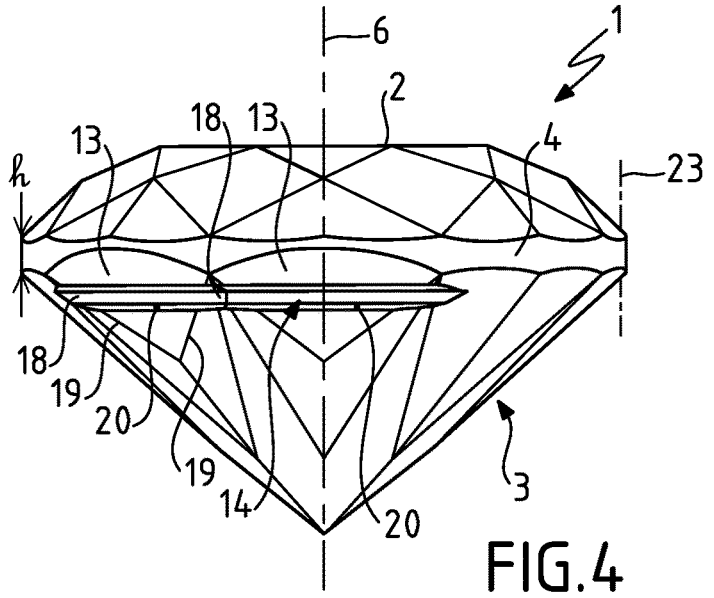
FIG. 4 is an elevation view of the stone of FIG. 3.
Figure 6:
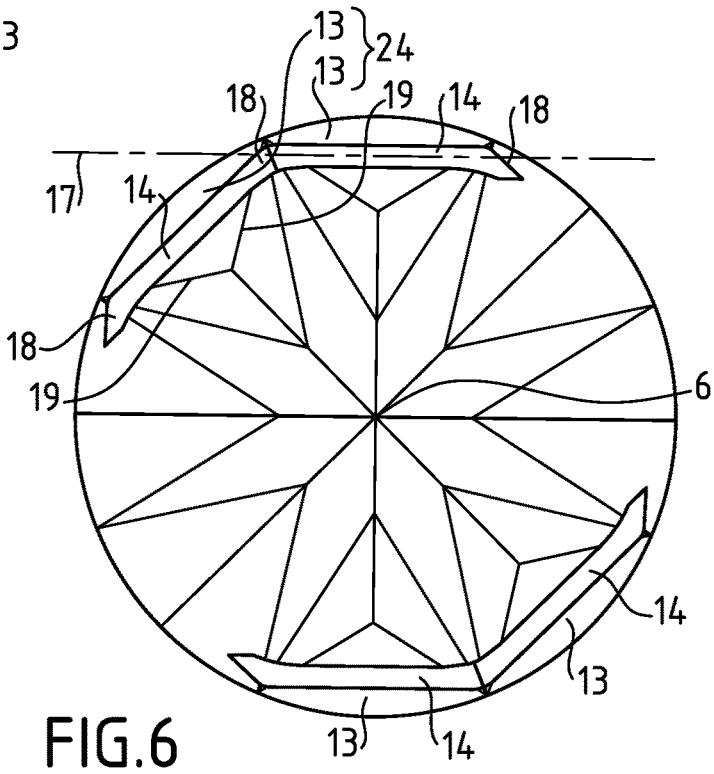
FIG. 6 is a view from below of the stone of FIGS. 3 to 5.
Figure 7:
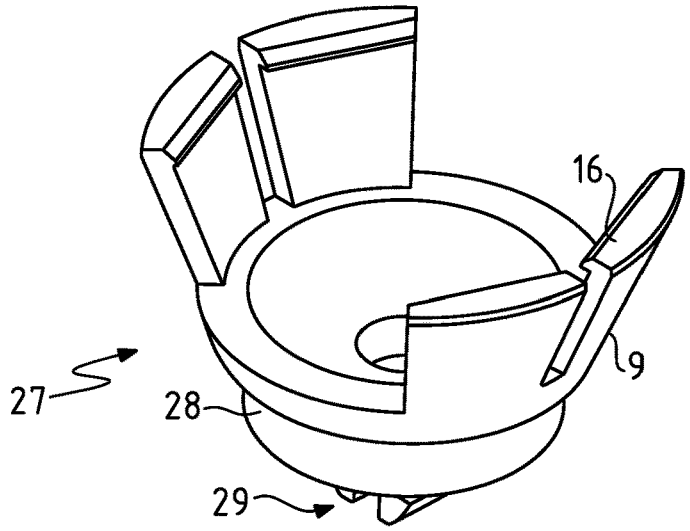
FIG. 7 is a perspective view of a pin for mounting the piece of jewellery of FIGS. 1 and 2.
Figure 8:
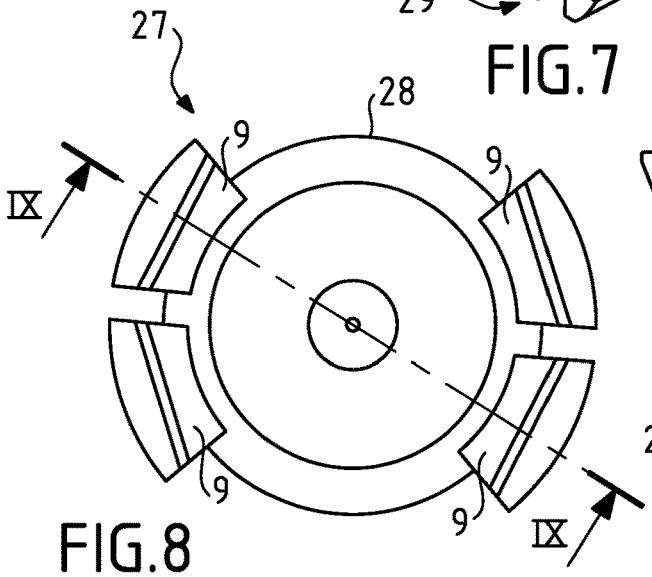
FIG. 8 is a view from above of the pin of FIG. 7.
Figure 9:
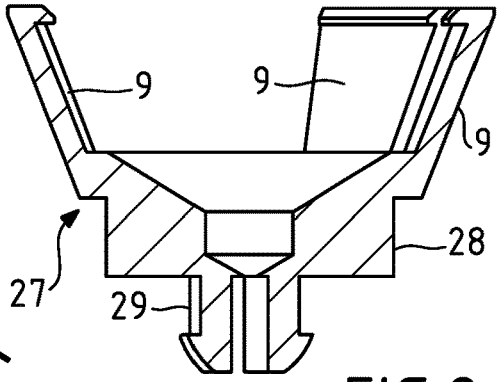
FIG. 9 is a sectional view along IX-IX of FIG. 8.
Figure 10:
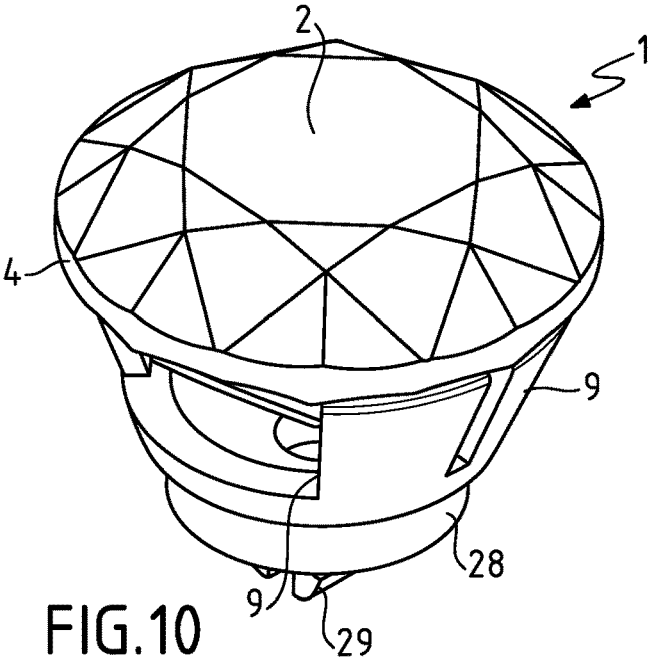
FIG. 10 is a perspective view of the stone of FIGS. 3 to 6 mounted on the pin of FIGS. 7 to 9.

As FIGS. 3, 4 and 6 show, in the embodiment represented, the facets 13 are grouped in pairs of neighbouring facets arranged in a V with respect to each other. The pairs are spaced apart from each other, preferably distributed evenly around the axis. By way of example, a pair is given the reference 24 in FIG. 6. The grooves 14 of two facets of one and the same pair 24 are linked to each other by a common end 18.

The mount 8 and its cooperation with the stones 1 will now be described more particularly, also with reference to FIGS. 7 to 10.

In an embodiment, each pin 27 has, for each facet 13, a claw 9 connected to a base 28 of the pin, by means of which the pin is fixed to the plate 26. In the example of FIGS. 1 to 10, each claw 9 is fixed to the base 28 independently of the other claws 9 of the pin.

In order to be fixed to the plate 26, in the embodiment represented the pin has means 29 for snapping into a respective recess 31 in the plate 26. In this particular example, this is two opposing snap-in hooks which engage underneath two opposite edges of the recess 31 produced in the form of a rectangular window.

The recess 31 has a shape (rectangular here) which, for the orientation of the pin 27 around its axis, only allows a number (2 here) of orientations at most equal to the order of symmetry of the pin 27 and the stone 1 around the axis 6. This is a means among others possible for orienting all the pins 27 and all the stones in the same way around their respective axis in the piece of jewellery (see FIG. 2, where the orientation of the pins and the stones is visible according to the position of the claws visible as dotted lines).

In an embodiment, the claws 9 associated with one and the same stone, therefore here belonging to one and the same pin 27, are elastically flexible in the direction in which they move apart from each other to receive the stone 1 by snapping the stone in between the associated claws 9.

In the finished piece of jewellery, with the stones 1 in contact or near contact with each other, the claws are located as much as possible underneath the points of contact or near contact 7 between girdles 4, as is clear in FIG. 2. This can be obtained by limiting the number of orientations the pins 27 are allowed with respect to the plate 26, as described previously.

Figure 11:
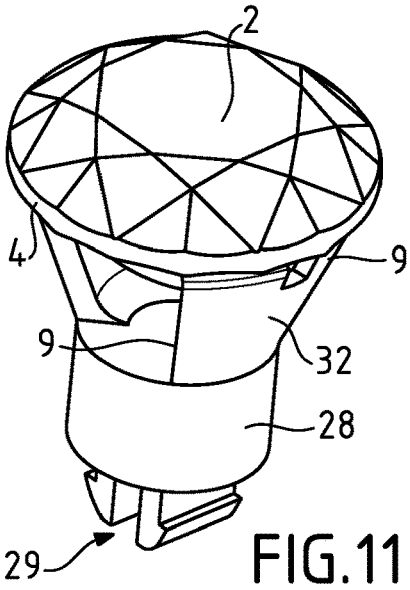
FIG. 11 is a view similar to FIG. 10 but with a smaller stone and a second embodiment of the pin.

The embodiment of FIG. 11 typically relates to stones of a smaller size, for example a diameter of 2.5 mm. For each pair 24 (FIG. 4) of facets 13, the mount has two abovementioned claws 9 having a common foot 32, separated from the foot 32 of the at least one other pair of claws 9.

Figure 12:
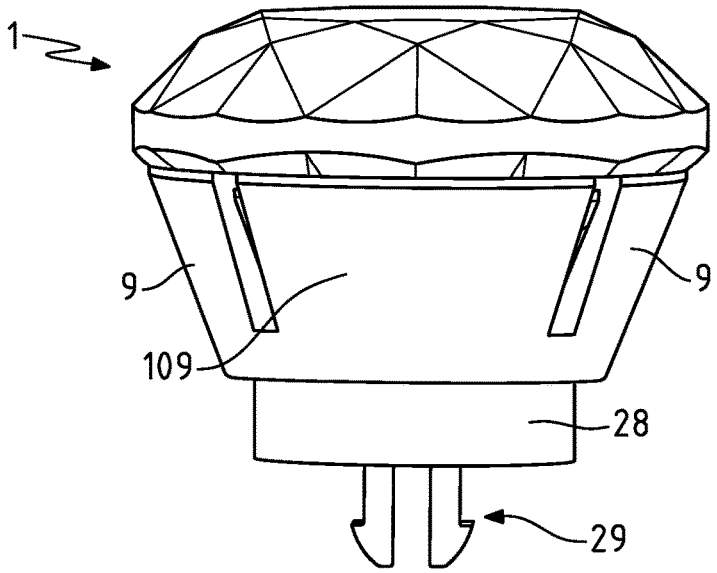
FIG. 12 is an elevation view showing the stone and the pin, in a third embodiment of the pin.
Figure 13:
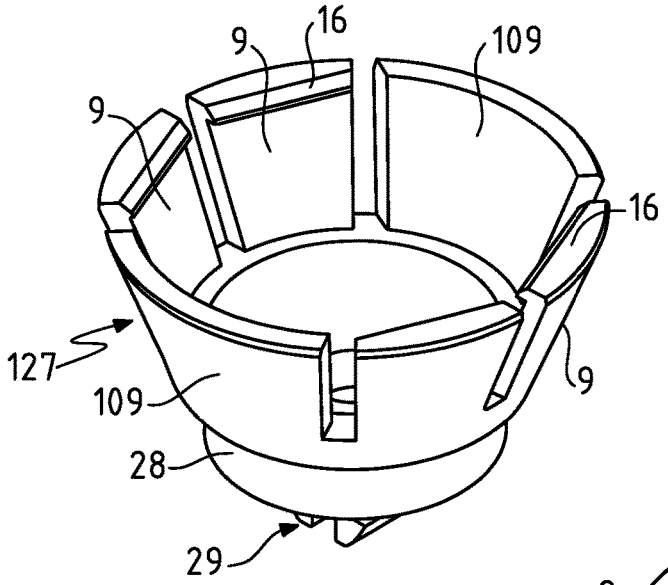
FIG. 13 is a perspective view of the pin of FIG. 12.

The embodiment of FIGS. 12 and 13 will be described only for its differences from that of FIGS. 7 to 10.

Between the successive claws 9 belonging to different pairs, the pin 127 has tabs 109 starting from the base 28, for retaining the stone 1 laterally. The tabs 109 differ from the claws 9 in particular in that they do not have a lip 16. The tabs 109 are separated from the claws 9 by slits 111 which allow the claws 9 to bend independently of the tabs 109. The tabs 109 are connected to the claws only by the base 28 of the pin 127 in this embodiment.

Figure 14:
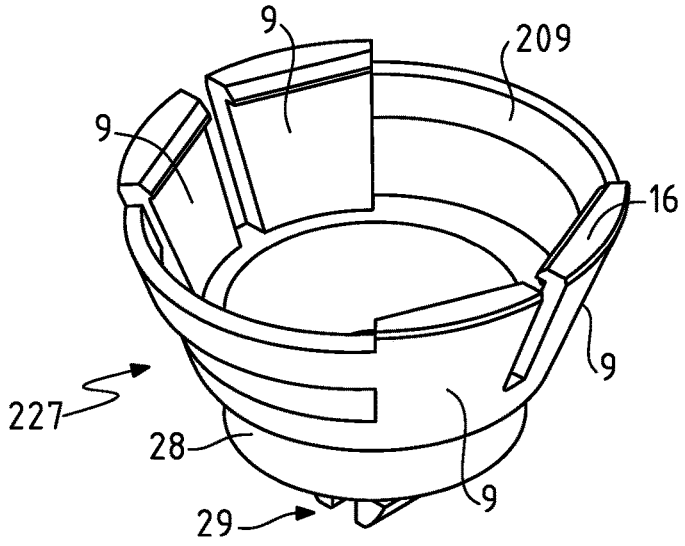
FIG. 14 is a perspective view of another embodiment of the pin.

In the embodiment of FIG. 14, which will be described only for its differences from that of FIGS. 12 and 13, the tabs 109 are replaced on the pin 227 with arches 209 which connect, as a single piece, the successive claws 9 belonging to different pairs. The arches 209 extend circumferentially at a certain distance from the base 28 and act as the tabs 109 for laterally retaining the stone mounted on the pin.

The features of the method which do not follow from the preceding description will now be described.

The grooves 14 can be machined by sawing, in particular in a plane 21 (FIG. 5) perpendicular to the axis 6.

The sawing or other machining is deep enough that the groove has a retaining face 20 (FIG. 5) undercut along its edge remote from the girdle 4.

Figure 5:
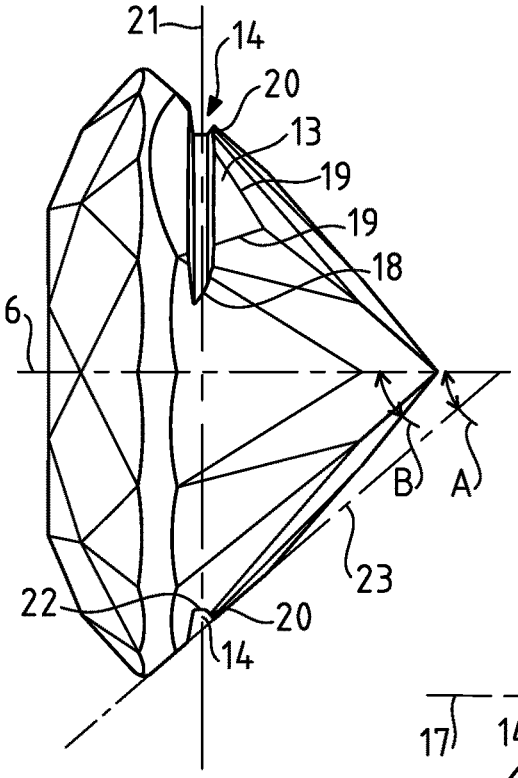
FIG. 5 is another elevation view of the stone of FIG. 3.

As illustrated by a dot-dash line 33 in FIG. 4, before the facets 13 are cut into a stone initially cut conventionally, for example as received by a supplier, it may be advantageous to cut the periphery of the stone again along the dot-dash line 33 so as to reduce its dimension perpendicular to the axis over its full circumference and jointly make the axial height of the girdle appear or increase. This makes it easier to create the facets 13 according to the invention and/or makes it possible to reduce their angle A further (FIG. 5). This, in turn, makes it easier to machine the grooves 14 and reduces the depth to be given to them in order for their edge remote from the visible surface to form an undercut giving the claws 9 grip. Less deep grooves are less likely to be detrimental to the light effects in the stone.

Of course, the invention is not limited to the examples described and represented. Only three claws and three grooves per stone could be provided.

The invention claimed is:

1. A piece of jewellery, comprising:

at least one stone, having a visible face with a round general shape and a pavilion with a conical general shape having an axis, separated from the visible face by a peripheral girdle;

a mount located essentially opposite the pavilion and having claws for supporting the at least one stone;

the peripheral girdle having a certain height (h) measured parallel to the axis;

the at least one stone having at least three facets overlapping the peripheral girdle and the pavilion, locally forming a bevel between the pavilion and the girdle; and each said at least three facets having a groove formed into it, extending transverse to the axis and receiving a lip of one of said claws.

2. The piece of jewellery according to claim 1, characterized in that the peripheral girdle has a cylindrical general shape.

3. The piece of jewellery according to claim 1, characterized in that in each said at least three facets the groove is open at both ends across a respective lateral facet edge.

4. The piece of jewellery according to claim 1, characterized in that a bottom of the groove is rectilinear.

5. The piece of jewellery according to claim 1, characterized in that the groove is formed in a plane perpendicular to the axis.

6. The piece of jewellery according to claim 1, characterized in that a bottom of the groove extends in a longitudinal direction parallel to a facet plane.

7. The piece of jewellery according to claim 1, characterized in that a bottom of the groove is a surface parallel to the axis.

8. The piece of jewellery according to claim 1, characterized in that the at least one stone has four facets and four grooves.

9. The piece of jewellery according to claim 1, characterized in that an angle (A) between the axis and a median of a facet located in an axial plane is of the order of 40°.

10. The piece of jewellery according to claim 1, characterized in that the at least three facets leave the girdle intact over a circumference of the visible face.

11. The piece of jewellery according to claim 1, characterized in that the at least three facets locally reduce an axial height of the peripheral girdle to a non-zero value.

12. The piece of jewellery according to claim 1, characterized in that the at least three facets are grouped in pairs of neighbouring facets arranged in a V with respect to each other, pairs of neighbouring facets being spaced apart from each other, and distributed evenly around the axis.

13. The piece of jewellery according to claim 12, characterized in that, for each pair of said at least three facets, the mount has two said claws having a common foot, separated from a foot of at least one other pair of said claws.

14. The piece of jewellery according to claim 1, characterized in that the mount has, for each said at least three facets, a claw connected to a base independently of other said claws.

15. The piece of jewellery according to claim 1, characterized in that the mount comprises a plate and, for each said at least one stone, a pin bearing said claws associated with said at least one stone.

16. The piece of jewellery according to claim 15, characterized in that the pin has means for snapping into a respective recess in the plate.

17. The piece of jewellery according to claim 1, characterized in that said claws associated with said at least one stone are elastically flexible in the direction in which they move apart from each other to receive said at least one stone by snapping in between said claws.

18. The piece of jewellery according to claim 1, characterized in that the at least one stone comprises several stones mounted with contact or near contact between the peripheral girdles of adjacent stones.

19. The piece of jewellery according to claim 18, characterized in that the claws are located underneath points of contact or near contact between peripheral girdles.

20. The piece of jewellery according to claim 1, characterized in that the mount comprises means for laterally retaining the at least one stone at least in certain spaces between successive claws associated with said at least one stone.

21. A method for cutting a stone with a view to producing a piece of jewellery according to claim 1, the stone having a visible face with a round general shape and a pavilion with a conical general shape having an axis, separated from the visible face by a peripheral girdle, comprising:

at least three facets overlapping the peripheral girdle and the pavilion are cut into the stone, locally forming a bevel between the pavilion and the peripheral girdle; and each facet has a groove formed into it, extending transverse to the axis.

22. The method according to claim 21, characterized in that said cutting of the facets remains below an upper limit of the peripheral girdle.

23. The method according to claim 21, characterized in that, before the facets are cut, a periphery of the at least one stone is cut again to reduce its dimension perpendicular to the axis over a full circumference of the at least one stone and jointly make an axial height (h) of the peripheral girdle appear or increase.

24. The method according to claim 21, characterized in that each said groove is formed by sawing.

25. The method according to claim 24, characterized in that the sawing is carried out in a plane perpendicular to the axis.

26. The method according to claim 24, characterized in that the sawing is deep enough that the groove has a retaining face undercut along an edge of the groove remote from the peripheral girdle.

27. A mounting pin for a piece of jewellery according to claim 1, or for a piece of jewellery obtained using a method for cutting a stone with a view to producing a piece of jewellery, the stone having a visible face with a round general shape and a pavilion with a conical general shape having an axis, separated from the visible face by a peripheral girdle, comprising:

at least three facets overlapping the peripheral girdle and the pavilion are cut into the stone, locally forming a bevel between the pavilion and the peripheral girdle; and each facet has a groove formed into it, extending transverse to the axis, the pin comprising:

a common base equipped with means for snapping into a plate; and at least three claws distributed around an axis, each having a snap-in lip directed towards the axis, and capable of moving apart from each other by elastic bending.

28. The mounting pin according to claim 27, characterized in that there is an even number of claws, grouped in pairs of neighbouring claws, the pairs being distributed evenly around the axis.

29. The mounting pin according to claim 28, characterized in that two said claws of one pair of said claws are connected to the base by a common foot, separate from a foot of the at least one other pair of said claws.

* * * * *